US011279906B2

(12) United States Patent
Piorkowski

(10) Patent No.: US 11,279,906 B2
(45) Date of Patent: Mar. 22, 2022

(54) UNIT DOSE DETERGENT PACKS WITH HIGH SOLVENT ANTI-EFFLORESCENCE FORMULATIONS

(71) Applicant: Henkel IP & Holding GmbH, Duesseldorf (DE)

(72) Inventor: Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 167 days.

(21) Appl. No.: 16/549,100

(22) Filed: Aug. 23, 2019

(65) Prior Publication Data

US 2021/0054316 A1 Feb. 25, 2021

(51) Int. Cl.

| | |
|---|---|
| ***C11D 17/04*** | (2006.01) |
| ***C11D 1/04*** | (2006.01) |
| ***C11D 1/83*** | (2006.01) |
| ***C11D 3/20*** | (2006.01) |
| ***C11D 3/30*** | (2006.01) |
| ***C11D 3/386*** | (2006.01) |
| ***C11D 3/00*** | (2006.01) |
| ***C11D 3/37*** | (2006.01) |
| *C11D 1/29* | (2006.01) |
| *C11D 1/72* | (2006.01) |

(52) U.S. Cl.

CPC ..... *C11D 17/043* (2013.01); *C11D 1/83* (2013.01); *C11D 3/0036* (2013.01); *C11D 3/2065* (2013.01); *C11D 3/2068* (2013.01); *C11D 3/2093* (2013.01); *C11D 3/30* (2013.01); *C11D 3/3707* (2013.01); *C11D 3/3765* (2013.01); *C11D 1/29* (2013.01); *C11D 1/72* (2013.01)

(58) Field of Classification Search

None

See application file for complete search history.

(56) References Cited

U.S. PATENT DOCUMENTS

| | | | | |
|---|---|---|---|---|
| 6,187,738 | B1 | 2/2001 | Micciche et al. | |
| 10,774,294 | B2 * | 9/2020 | Piorkowski | C11D 3/43 |
| 2009/0105113 | A1 * | 4/2009 | Tuzi | C11D 1/37 510/418 |
| 2010/0234271 | A1 * | 9/2010 | Scheuing | C11D 3/33 510/465 |
| 2015/0275148 | A1 | 10/2015 | Joiner et al. | |
| 2015/0329807 | A1 * | 11/2015 | Naqvi | C11D 3/2041 206/524.7 |
| 2016/0040105 | A1 * | 2/2016 | Depoot | C11D 1/83 510/296 |
| 2016/0355767 | A1 * | 12/2016 | Souter | C11D 17/043 |
| 2018/0265825 | A1 | 9/2018 | Park | |
| 2018/0334641 | A1 | 11/2018 | Piorkowski | |
| 2019/0048296 | A1 | 2/2019 | Pirokowski | |
| 2019/0112563 | A1 | 4/2019 | Piorkowski | |
| 2019/0127669 | A1 | 5/2019 | Piorkowski et al. | |

* cited by examiner

*Primary Examiner* — Lorna M Douyon

(74) *Attorney, Agent, or Firm* — Bojuan Deng

(57) ABSTRACT

Unit dose packs and methods for producing the same are provided. In an exemplary embodiment, a unit dose pack includes a film and a wash composition encapsulated within the film. The wash composition includes a glycol ether in an amount of from about 2 to about 15 weight percent, glycerin in an amount of from about 15 to about 26 weight percent, and polyethylene glycol in an amount of from about 0 to about 12 weight percent, all based on a total weight of the wash composition. A sum of the amounts of the glycol ether, the glycerin, and the polyethylene glycol is from about 26 to about 40 weight percent, based on the total weight of the wash composition.

20 Claims, 1 Drawing Sheet

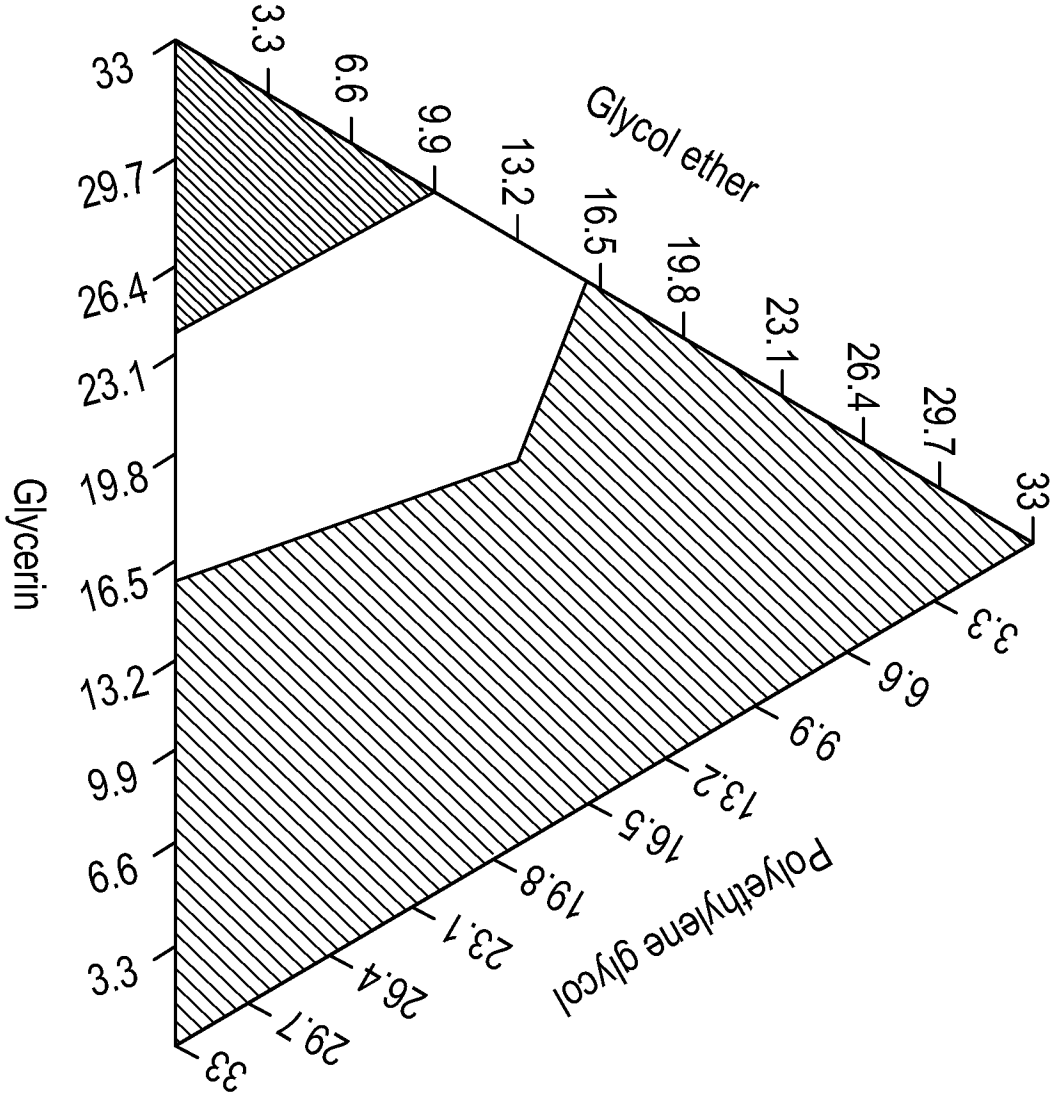
Glycerin
33
29.7
26.4
23.1
19.8
16.5
13.2
9.9
6.6
3.3
Glycol ether
3.3
6.6
9.9
13.2
16.5
19.8
23.1
26.4
29.7
33
Polyethylene glycol
33
29.7
26.4
23.1
19.8
16.5
13.2
9.9
6.6
3.3

UNIT DOSE DETERGENT PACKS WITH HIGH SOLVENT ANTI-EFFLORESCENCE FORMULATIONS

FIELD OF THE INVENTION

The technical field relates to unit dose packs that include a wash composition with reduced efflorescence, and more particularly relates to unit dose packs with reduced efflorescence and with high solvent loadings, and methods of producing the same.

BACKGROUND OF THE INVENTION

Detergent in unit dose packs are available for a variety of washing activities, such as garment laundering and dish washing. The unit dose pack provides a pre-measured quantity of detergent that is easy to carry and convenient to use. The unit dose pack minimizes over-dosage of detergent and has proven popular with consumers.

Many unit dose packs include a wash composition that is encapsulated within a pouch made of a water soluble film, where the wash composition includes detergent, solvents, and other components useful for cleaning or other purposes. In many cases, the film is clear, so the contents are visible. Some consumers interested in reduced environmental impact prefer a product that is free of colorants and perfumes, so the product appears clear. Some consumers prefer to see the contents of the unit dose pack for aesthetic or other reasons. However, some components of the wash composition tend to effloresce in the film, where efflorescence is the migration of a salt or other solid to the surface of a solid. In the case of unit dose packs, materials tend to effloresce in the film such that the film of the unit dose packs appears and feels "grainy." Increased solvent loadings in the wash composition encapsulated within the film tend to increase the propensity for efflorescence, but increased solvent loadings can reduce costs. The grainy appearance and feel of a film with efflorescence may be negatively perceived by consumers.

Accordingly, it is desirable to provide a unit dose pack with higher solvent loadings and with reduced efflorescence. In addition, it is desirable to provide unit dose packs that have favorable properties such as desirable haptics, viscosity, and water activity, and still provide reduced efflorescence in the film over time. Methods of producing the same are also desirable. Furthermore, other desirable features and characteristics will become apparent from the subsequent detailed description and the appended claims, taken in conjunction with the accompanying drawing and the foregoing technical field and background.

BRIEF SUMMARY OF THE INVENTION

Unit dose packs and methods for producing the same are provided. In an exemplary embodiment, a unit dose pack includes a film and a wash composition encapsulated within the film. The wash composition includes a glycol ether in an amount of from about 2 to about 15 weight percent, glycerin in an amount of from about 15 to about 26 weight percent, and polyethylene glycol in an amount of from about 0 to about 12 weight percent, all based on a total weight of the wash composition. A sum of the amounts of the glycol ether, the glycerin, and the polyethylene glycol is from about 26 to about 40 weight percent, based on the total weight of the wash composition.

A method of producing a unit dose pack is provided in another embodiment. The method includes forming a wash composition that includes a glycol ether in an amount of from about 2 to about 15 weight percent, glycerin in an amount of from about 15 to about 26 weight percent, and polyethylene glycol in an amount of from about 0 to about 12 weight percent, all based on a total weight of the wash composition. The sum of the amounts of the glycol ether, the glycerin, and the polyethylene glycol is from about 26 to about 40 weight percent, based on the total weight of the wash composition. The wash composition is encapsulated within a film to produce the unit dose pack.

A unit dose pack is provided in yet another embodiment. The unit dose pack includes a film and a wash composition encapsulated within the film. The wash composition includes monoethanol amine in an amount of from about 0.5 to about 5 weight percent, a coconut fatty acid in an amount of from about 0.5 to about 8 weight percent, an anionic surfactant in an amount of from about 20 to about 35 weight percent, a nonionic ethoxylated surfactant in an amount of from about 15 to about 30 weight percent, an optical brightener in an amount of from about 0.1 to about 1 weight percent, a bittering agent in an amount of from about 0.001 to about 0.2 weight percent, diethylene glycol monobutyl ether in an amount of from about 3 to about 12 weight percent, glycerin in an amount of from about 16 to about 25 weight percent, and polyethylene glycol in an amount of from about 0 to about 10 weight percent, all based on a total weight of the wash composition.

BRIEF DESCRIPTION OF THE DRAWINGS

The present embodiments will hereinafter be described in conjunction with the following FIGURE, wherein:

FIG. 1 is a triangular chart showing an exemplary embodiment of non-aqueous solvent concentrations and acceptable specifications for a wash composition including the non-aqueous solvents.

DETAILED DESCRIPTION OF THE INVENTION

The following detailed description is merely exemplary in nature and is not intended to limit the unit dose pack, or the method for producing or using the same. Furthermore, there is no intention to be bound by any theory presented in the preceding background or the following detailed description.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

A unit dose pack includes a wash composition encapsulated within a film. The wash composition includes a surfactant and other components, and also includes non-aqueous solvents that are glycol ethers, glycerin, and optionally polyethylene glycol. The quantities and ratios of the non-aqueous solvents are set to produce a wash composition with reduced efflorescence, as compared to other wash compositions with high solvent loadings, such as non-aqueous solvent loadings of about 30 weight percent or more. Solvent loadings refer to the total concentration of solvents in the wash composition, so higher solvent loadings have more solvent than lower solvent loadings for the same sized unit dose pack.

A unit dose pack is formed by encapsulating a wash composition within a film, e.g. where the film forms a container for the wash composition. In some embodiments, the film forms one half or more of the container, where the container may also include dyes, print, or other components in some embodiments. The film is water soluble such that the film will dissolve when an exterior of the film is exposed to water, such as in a washing machine typically used for laundry. In some embodiments, the film will completely dissolve in water. When the film dissolves, the container ruptures and the contents are released. As used herein, "water soluble" means at least 2 grams of the solute (the film in one example) will dissolve in 5 liters of water, for a solubility of at least 0.4 grams per liter (g/l), at a temperature of 25 degrees Celsius (° C.) unless otherwise specified. Suitable films for packaging are rapidly soluble in water at temperatures of about 5° C. or greater.

The film is desirably strong, flexible, shock resistant, transparent, and non-tacky during storage at both high and low temperatures and high and low humidity's. In an exemplary embodiment, the film is initially formed from polyvinyl acetate, and at least a portion of the acetate functional groups are hydrolyzed to produce alcohol groups. Therefore, the film typically includes polyvinyl alcohol (PVOH), and may include a higher concentration of PVOH than polyvinyl acetate. Such films are commercially available with various levels of hydrolysis, and thus various concentrations of PVOH. In an exemplary embodiment the film initially has about 85 percent of the acetate groups hydrolyzed to alcohol groups, but other percentages of hydrolysis are also possible in alternate embodiments. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 65 to about 90 μm in various embodiments. The film may include alternate materials in some embodiments, such as methyl hydroxy propyl cellulose and polyethylene oxide, but the film is water soluble in all embodiments.

The unit dose pack may be formed from a container having a single section, but the unit dose pack may be formed from containers with two or more different sections in alternate embodiments. In embodiments with a container having two or more sections, the contents of the different sections may or may not be the same. In some embodiments, the unit dose pack is formulated and configured for cleaning laundry, but other cleaning purposes are also possible. The wash composition is positioned within the container, and the container is sealed to encapsulate and enclose the wash composition. The wash composition is typically in direct contact with the film of the container within the unit dose pack. The film of the container is sealable by heat, heat and water, ultrasonic methods, or other techniques, and one or more sealing techniques may be used to enclose the wash composition within the container.

In an exemplary embodiment, the wash composition is liquid when encapsulated within the container. The liquid wash composition may have a viscosity of from about 125 to about 1,000 centipoise, or from about 125 to about 300 centipoise in different embodiments, where "viscosity," as used herein, means the viscosity measured by a rotational viscometer at a temperature of 25 degrees Celsius (° C.) using an LV02 cylindrical spindle at about 20 revolutions per minute (RPM) with a Brookfield® DV2T viscometer. The liquid form facilitates rapid delivery and dispersion of the wash composition once the container ruptures, and this rapid dispersion can aid cleaning. In alternate embodiments, the wash composition is flowable, such as a gel, a liquid with suspended particulates, or other forms. A viscosity of about 125 centipoise or greater may reduce splashing and thereby improve packaging processes.

In an exemplary embodiment, the unit dose pack is sized to provide a desired quantity of wash composition for one load of laundry or one batch of dishes in a dishwasher. The unit dose pack may also be sized for a fraction of a desired quantity, such as one half of a load of laundry, so a user can adjust the amount of detergent added without having to split a unit dose pack. In an exemplary embodiment, the unit dose pack has a weight of from about 5 to about 50 grams. In alternate embodiments, the unit dose pack is from about 10 to about 40 grams, or from about 15 to about 25 grams.

A plurality of components are combined to form the wash composition, where the wash composition is typically prepared prior to encapsulation within the container. A total weight of the wash composition does not include the weight of the film or the container, where the total weight of the wash composition is generally referenced herein as the basis for the weight percent of components of the wash composition. Unless otherwise specified, the concentration of all components described herein, other than the film, is the weight percent of the named component based on the total weight of the wash composition.

The wash composition includes a glycol ether and glycerin, and may include polyethylene glycol. It has been discovered that providing the glycol ether, glycerin, and polyethylene glycol within specific concentration ranges produces a wash composition that is high in solvent (i.e., about 28 weight percent non-aqueous solvent or more), and that has a reduced tendency to effloresce as compared to other wash compositions with the same solvent loadings.

In an exemplary embodiment, the sum of the concentrations of the glycol ether, the glycerin, and the polyethylene glycol in the wash composition is from about 25 to about 50 weight percent, based on the total weight of the wash composition. However, in alternate embodiments the sum of the concentrations of the glycol ether, the glycerin, and the polyethylene glycol in the wash composition is from about 26 to about 40 weight percent, or from about 27 to about 35 weight percent, or from about 28 to about 34 weight percent, all based on the total weight of the wash composition. Higher concentrations of the glycol ether tend to produce a unit dose pack with better haptics, where the film in the unit dose pack is more stable and resilient. As such, increased glycol ether concentrations have a beneficial impact as compared to lower glycol ether concentrations.

The glycol ether is present in the wash composition in an amount of from about 2 to about 15 weight percent in an exemplary embodiment, based on the total weight of the wash composition. However, in alternate embodiments, the glycol ether is present at from about 3 to about 12 weight percent in the wash composition, or about 3 to about 8 weight percent, based on the total weight of the wash composition. The glycol ether is diethylene glycol monobutyl ether in an exemplary embodiment, but other glycol ethers may be utilized in alternate embodiments.

Glycerin is present in the wash composition in an amount of from about 15 to about 26 weight percent in an exemplary embodiment, based on the total weight of the wash composition. However, glycerin may be present in the wash composition at from about 16 to about 25 weight percent, or from about 17 to about 23 weight percent, in alternate embodiments, based on the total weight of the wash composition. A ratio of the concentration of the glycol ether to the concentration of the glycerin may be from about 0.1 to about 1.0 in an exemplary embodiment, but the ratio may be from about 0.15 to about 0.6 or from about 0.2 to about 0.5 in other embodiments.

In an exemplary embodiment, the polyethylene glycol is present in the wash composition at from about 0 to about 12 weight percent, based on the total weight of the wash composition. In alternate embodiments the polyethylene glycol may be present in the wash composition at from about 0 to about 10 weight percent, or from about 2 to about 10 weight percent, based on the total weight of the wash composition. The polyethylene glycol may have a weight average molecular weight of from about 300 to about 600 daltons in an exemplary embodiment, but in alternate embodiments the polyethylene glycol has a weight average molecular weight of from about 300 to about 500, or from about 350 to about 450, or about 400 daltons. However, other average molecular weights of the polyethylene glycol are also possible.

A solvent is a component that is utilized as a carrier in a formulation, where other components (solutes) are dissolved in the solvent. Solvents generally solvate solutes and act as bulk fillers for the formula when used below a certain use-level so as to not plasticize the film. Specific criteria that precisely and exactly define what is or is not a solvent are difficult to define, because some components may have more than one purpose. Generally, solvents for liquid formulations are liquids at standard conditions (i.e., 1 atmosphere pressure and 20 degrees Celsius (° C.)). Typically, ionic surfactants, nonionic surfactants, optical brighteners, dyes or pigments, bleach activators or agents, enzymes, perfumes or other ingredients added for odor purposes, bittering agents, peroxy compounds, soil release agents, dye transfer inhibitors, foam inhibitors, chelators or other water softeners are not considered "solvents." The wash composition includes one or more solvents in an exemplary embodiment. For example, water may be present in the wash composition at a concentration of from about 3 to about 45 weight percent, or present in an amount of from about 4 to about 35 weight percent, or present in an amount of from about 7 to about 25 weight percent, in various embodiments, based on the total weight of the wash composition. In general, the water is present in an amount such that a water activity value is about 0.7 or less, or 0.65 or less, or 0.6 or less in various embodiments. Water activity is the partial vapor pressure of water in the wash composition divided by the partial vapor pressure of pure water at the same temperature. Lower water activity values facilitate use of the film, so the water present in the wash composition does not dissolve the film prior to use.

Other non-aqueous solvents that may be included in the wash composition include, but are not limited to, glycerin, polyethylene glycol, glycol ethers, ethylene glycol, ethanol, and a 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a weight average molecular weight of 3,500 daltons or less; and ethoxylated fatty acids. The glycol ether, glycerin, and optionally the polyethylene glycol described above are non-aqueous solvents in the wash composition.

The wash composition includes other components as well. For example, the wash composition may include one or more ionic surfactants, where the ionic surfactant is formulated for laundry in an exemplary embodiment. The ionic surfactant may include one or more surfactants, including cationic and/or anionic surfactants, in various embodiments. The ionic surfactant may be present in the wash composition at a concentration of from about 5 to about 60 weight percent in one embodiment, but the ionic surfactant may be present in the wash composition at a concentration of about 10 to about 55 weight percent, or from about 20 to about 50 weight percent, or from about 20 to about 35 weight percent in alternate embodiments, based on a total weight of the wash composition.

Suitable ionic surfactants that are anionic include soaps which contain sulfate or sulfonate groups, including those with alkali metal ions as cations. Usable soaps include alkali metal salts, amine salts, or other salts of saturated or unsaturated fatty acids with 12 to 18 carbon (C) atoms. Such fatty acids may also be used in incompletely neutralized form, such that some of the fatty acids are present in a salt form and other fatty acids are present in a free acid form where an acid group is protonated. Usable anionic surfactants of the sulfate type include sulfuric acid semi esters of fatty alcohols with 12 to 18 C atoms, and/or alcohol ethoxysulfates, where these compounds may be present in a salt form. Usable anionic surfactants of the sulfonate type include alkane sulfonates with 12 to 18 C atoms and olefin sulfonates with 12 to 18 C atoms, such as those that arise from the reaction of corresponding mono-olefins with sulfur trioxide. Another type of sulfonate surfactant includes alpha-sulfofatty acid esters such as those that arise from the sulfonation of fatty acid methyl or ethyl esters, and lauryl ether sulfates.

In an exemplary embodiment, the wash composition includes linear alkyl benzene sulfonic acid surfactants as the anionic surfactant at a concentration of from about 10 to about 45 weight percent, or from about 20 to about 40 weight percent, or from about 20 to about 35 weight percent in different embodiments. In an exemplary embodiment, linear alkylbenzene sulfonates include 9 to 14 C atoms in the alkyl moiety.

Suitable ionic surfactants that are cationic may include textile-softening substances of the general formula X, XI, or XII as illustrated below:

(X)

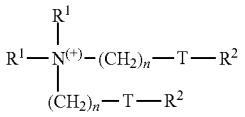

(XI)

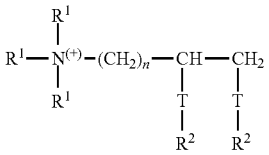

-continued (XII)

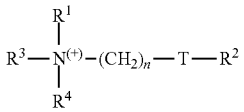

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO—, or —CO—O—, and n is an integer from 0 to 5. The cationic surfactants may include conventional anions of a nature and number required for charge balancing. Alternatively, the ionic surfactant may include anionic surfactants that may function to balance the charges with the cationic surfactants. In some embodiments, cationic surfactants may include hydroxyalkyltrialkylammonium compounds, such as $C_{12-18}$ alkyl(hydroxyethyl)dimethyl ammonium compounds, and may include the halides thereof, such as chlorides or other halides. The ionic surfactants that are cations may be especially useful for compositions intended for treating textiles.

Nonionic surfactants may optionally be present in the wash composition at a concentration of from about 0 to about 60 weight percent, or from about 5 to about 50 weight percent, or from about 10 to about 40 weight percent, or from about 15 to about 30 weight percent in various embodiments, based on the total weight of the wash composition. Suitable nonionic surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Several other components may optionally be added to and included in the wash composition, including but not limited to water-binding saccharides, enzymes, peroxy compounds, bleach activators, anti-redeposition agents, pH adjusting agents, optical brighteners, foam inhibitors, buttering agents, dye transfer inhibitors, soil release agents, and other components. A partial, non-exclusive list of additional components that may be added to and included in the wash composition include electrolytes, pH regulators, graying inhibitors, anti-crease components, processing aids, antimicrobial agents, and preservatives.

Water binding saccharides are optionally included in the wash composition. In some embodiments, the saccharide is selected from the group of fructose, glucose, sucrose, xylitol, sorbitol, mannitol, erythritol, dulcitol, inositol, adonitol, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligosaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, high fructose corn/starch syrup, coupling sugars, soybean oligosaccharides, or glucose syrup, and a mixture thereof.

One example of a saccharide that may be utilized is high fructose corn syrup (HFCS.) HFCS typically refers to a blend of approximately 23% water and 77% saccharide. For example, HFCS 55 typically refers to a blend of water (about 23%), glucose (about 34%), and fructose (about 42%). However, in a dried form, HFCS 55 contains approximately 55% fructose by weight of dry HFCS, where the number after the abbreviation HFCS generally refers to the percentage of fructose in a dry state. Unless otherwise stated, HFCS used herein refers to a wet blend which contains water, as it is supplied from HFCS manufacturers. However, it should be understood that dry or essentially dry hybrids of monosaccharides (e.g. HFCS), wherein water has been removed partially or completely, can also be used. Other HFCS products may also be used, such as HFCS 42, HFCS 65, HFCS 90, and others. While pure fructose is very viscous and hard to handle, HFCS is more dilute and easier to handle. HFCS is also more cost-effective to manufacture. The United States Food and Drug Administration has even determined that HFCS is a safe ingredient for food and beverage manufacturing. It is certainly a safe and green ingredient for detergent products.

Foam inhibitors may optionally be included in the wash composition. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, coconut fatty acids are used as foam inhibitors, but other embodiments are possible, such as mixtures of paraffins and bistearylethylenediamide. The wash composition may include the foam inhibitor at an amount of from about 0 to about 15 weight percent, but in other embodiments the foam inhibitor may be present at an amount of from about 0.05 to about 10 weight percent, or an amount of from about 0.5 to about 8 weight percent, based on the total weight of the wash composition.

PH adjusting agents may be added to and included in the wash composition. Exemplary pH adjusting agents include monoethanol amine, binary amines, buffers, triethanol amine, metal hydroxides, or other materials. Exemplary metal hydroxides are sodium hydroxide and/or potassium hydroxide, and other possible pH adjusting agents include compounds that adjust the pH of the wash composition. pH adjusting agents may be present in the wash composition at an amount of from about 0.1 to about 10 weight percent in some embodiments, based on the total weight of the wash composition, but in other embodiments the pH adjusting agent may be present in the wash composition at an amount of from about 0.5 to about 5 weight percent, or an amount of from about 1 to about 4 weight percent, based on the total weight of the wash composition. The pH adjusting agent may be utilized to adjust the pH of the wash composition to from about 6 to about 10, or from about 6.5 to about 9.5, or from about 7 to about 9 in various embodiments. The pH adjusting agent may form a cation that combines with an anionic surfactant and/or a coconut fatty acid or other foam inhibitor and/or another anionic component within the wash composition. In many cases, the pH adjusting agent forms a salt with an anionic component. As such, the anionic surfactant may be present in the wash composition as a surfactant salt, and the coconut fatty acid may be present in the wash composition as a coconut fatty acid salt. In some embodiments, the pH adjusting agent is included in a slight excess relative to the anionic surfactant or other acidic components to adjust the pH of the wash composition to within a desired range, such as the range(s) mentioned above. As used herein, the terms "anionic surfactant" and "coconut fatty acid" include the neutralization products thereof.

Possible enzymes that may be in the wash composition contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) should be compatible with the selected wash composition, (i.e., pH-optimum, compatibility with other enzymatic and non-enzymatic ingredients, etc.). The detergent enzyme(s) may be included in the wash composition by adding separate additives containing one or more enzymes, or by adding a combined additive comprising all the enzymes that are added to the wash composition. The enzyme(s) should be present in the wash composition in effective amounts, such as from about 0 weight percent to about 5 weight percent of enzyme, or from about 0.001 to about 5 weight percent, or from about 0.2 to about 3 weight percent, or from about 0.5 to about 3 weight percent, based on the total weight of the wash composition, in various embodiments. In an exemplary embodiment, the wash composition includes three or more different enzymes. In one embodiment, the wash composition includes protease, mannanase, and amylase, but other embodiments are also possible.

A peroxy compound may optionally be present in the wash composition. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the wash composition at an amount of from about 0 to about 15 weight percent, or an amount of from about 1 to about 10 weight percent, or an amount of from about 3 to about 5 weight percent, based on the total weight of the wash composition, in various embodiments.

Bleach activators may optionally be added and included in the wash composition. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the wash composition, in a known manner. As such, the bleach activator and/or other components may be present in a liquid wash composition as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In alternate embodiments, the peroxy compounds and bleach activators, if present, may be within separate chambers of the container to prevent premature interactions. In various embodiments, the bleach activators may be present in the wash composition in quantities of from about 0 to about 8 weight percent, or from about 0 to about 6 weight percent, or from about 0 to about 4 weight percent, in each case relative to the total weight of the wash composition.

One or more anti-redeposition agents may also be optionally included in the wash composition. Anti-redeposition agents include polymers with a soil detachment capacity, which are also known as "soil repellents" due to their ability to provide a soil-repelling finish on the treated surface, such as a fiber. One example in regard to polyesters includes copolyesters prepared from dicarboxylic acids, such as adipic acid, phthalic acid or terephthalic acid. Other polymers may also function as anti-redeposition agents. In an exemplary embodiment, the anti-redeposition agent is a sodium methylacrylate styrene co-polymer, but other polymers may also be used. Efflorescence is generally increased when the wash composition includes an anti-redeposition agent.

In other exemplary embodiment, the anti-redeposition agent includes polyesters with a soil detachment capacity that include those compounds which, in formal terms, are obtainable by esterifying two monomer moieties, the first monomer being a dicarboxylic acid HOOC-Ph-COOH and the second monomer a diol $HO—(CHR^{11}—)_aOH$, which may also be present as a polymeric diol $H—(O—(CHR^{11}—)_a)_bOH$. Ph here means an ortho-, meta- or para-phenylene residue that may bear 1 to 4 substituents selected from alkyl residues with 1 to 22 C atoms, sulfonic acid groups, carboxyl groups and mixtures thereof. $R^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units $—O—(CHR^{11}—)_aO—$ but also polymer diol units $—(O—(CHR^{11}—)_a)_bO—$. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The weight average molecular weight of the polyesters with a soil detachment capacity may be in the range of from about 250 to about 100,000 daltons, or from about 500 to about 50,000 daltons in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols $HO—(CHR^{11}—)_aOH$ include those in which $R^{11}$ is hydrogen and "a" is a number of from about 2 to about 6, and in another embodiment includes those in which "a" has the value of 2 and $R^{11}$ is selected from hydrogen and alkyl residues with 1 to 10 C atoms, or where $R^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with a weight average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, and benzoic acid. These end groups may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, hydrogenation products thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the wash composition at an amount of from about 0 to about 5 weight percent, or an amount of from about 0.5 to about 5 weight percent, or an amount of from about 0.5 to about 3 weight percent, based on the total weight of the wash composition, in various embodiments.

Optical brighteners may optionally be included in the wash composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl) diphenyl. Mixtures of the above-stated optical brighteners may also be used. Optical brighteners may be present in the wash composition at an amount of from about 0 to about 5 weight percent in some embodiments, but in other embodiments optical brighteners are present in an amount of from about 0.005 to about 5 weight percent, or an amount of from about 0.01 to about 1 weight percent, or an amount of from about 0.05 to about 0.3 weight percent, based on the total weight of the wash composition.

Bittering agents may optionally be added to hinder accidental ingestion of the unit dose pack or the wash composition. Bittering agents are compositions that taste bad, so children or others are discouraged from accidental ingestion. Exemplary bittering agents include denatonium benzoate, aloin, and others. Bittering agents may be present in the wash composition at an amount of from about 0 to about 1 weight percent, or an amount of from about 0 to about 0.5 weight percent, or an amount of from about 0 to about 0.1 weight percent in various embodiments, based on the total weight of the wash composition.

Extended storage (a storage period of about a week or more) at an elevated temperature of about 40 degrees Celsius (° C.) or more may result in efflorescent solids forming in the film, with efflorescent solids forming in the film at lower temperatures and/or storage times in some cases. In some embodiments, a unit dose pack is warehoused or stored for a period of time before use, and this storage is often for a week or more and at a temperature of 40° C. or more. Therefore, a unit dose pack that was originally produced without efflorescent solids in the film may produce efflorescent solids in the film after storage.

It has unexpectedly been discovered that reduced or limited efflorescence is possible when specific concentrations of glycol ethers, glycerin, and polyethylene glycol are incorporated into the wash composition at a total concentration of about 27 to 35 weight percent. In general, reduced efflorescence is seen when the glycol ethers are present at from about 2 to about 15 weight percent, the glycerin is present from about 15 to about 26 weight percent, and the optional polyethylene glycol is present at from about 0 to about 12 weight percent, based on the total weight of the wash composition.

In this description, the amount of efflorescence is measured with an "efflorescence value," where the efflorescence value is defined as follows: a value of 0 means no efflorescence is visible or detectable by feel; a value of 10 means no efflorescence is visible but efflorescence can be detected by feeling a roughness on the film; a value of 20 means efflorescence is visible on over 10% of the surface area of the film but less than 20% of the surface area of the film; a value of 25 means efflorescence is visible on over 20% of the surface area of the film, but less than 30% of the surface area of the film; a value of 30 means efflorescence is very easily visible, such as visible on over 30% of the surface area of the film but less than 75% of the surface area of the film; a value of 40 means over 75% of the surface area of the film is visibly covered with efflorescence, but less than 95% of the surface area of the film is visibly covered with efflorescence; and a value of 50 means over 95% of the surface area of the film is visibly covered with efflorescence. The visual test is performed by the naked eye, where efflorescence is a detectable haze in the film. A haze in the film is a cloudy appearance, so efflorescence is visible when the film has a hazy or cloudy appearance. The efflorescence value may be interpolated between the reference points described above. The standard efflorescence value is measured on a unit dose pack after storage for 2 weeks at a temperature of about 45° C., unless otherwise specified.

The unit dose pack may have certain specifications or requirements. For example, one specification for the wash composition is the water activity. The wash composition has a water activity of about 0.7 or less, or a water activity of 0.65 or less, or a water activity of 0.6 or less in various embodiments. Lower water activity values tend to produce more stable unit dose packs, because the film is soluble in water and high water activity values indicate higher values of free water. Another possible specification is viscosity. The viscosity of the wash composition may be about 125 centipoise or more, as described above. The unit dose pack may have an efflorescence specification, where the unit dose pack has an efflorescence value of about 25 or less, as defined above, when stored for 2 weeks at about 45° C., also as described above.

The unit dose pack may have a haptics value specification of about 1.250 centimeters or greater, or a haptics value of about 1.204 centimeters or greater in various embodiments. Unit dose packs tend to lose some pack height with storage, and the amount of pack height loss is a good indication of the haptics of the pack. The haptics specification was consistently measured for all samples, where larger changes in pack height over time were interpreted to indicate poorer haptics, and smaller changes in pack height over time were interpreted to indicate better haptics. A unit dose pack with a larger pack height has a more appealing appearance to a user, where a package with several unit dose packs looks fuller and each unit dose pack appears fresher and more appealing. The unit dose packs for the test samples were all prepared using the same total quantities of wash composition, as well as the same pack production equipment, so the original pack heights were all about the same. The haptics value was determined by measuring the height of the unit dose pack after a storage period of 1 week. Height of the unit dose pack was measured using an Ames Logic Basic Digital Comparator Model BG1110-1-04, on a column mounted indicator, model 99-0697. Height of the unit dose pack was measured by placing the unit dose pack under a digital indicator, after the scale was zeroed.

The wash composition may be prepared by combining and mixing the components of the wash composition with a mixer. Once mixed, the wash composition is encapsulated within the film to produce the unit dose pack. The components of the wash composition may all be mixed at one time, or different components may be pre-mixed and then combined. A wide variety of mixers may be used in alternate embodiments, such as an agitator, an in-line mixer, a ribbon blender, an emulsifier, and others. The film is positioned within a mold, wash composition is placed over the film within the mold, and another film is laid over the mold and the wash composition such that the wash composition is positioned between the two films. The film is then sealed with a sealer, where the sealer may utilize heat, water, ultrasonic techniques, water and heat, pressure, or other techniques for sealing the wash composition within the film and forming the unit dose pack.

EXAMPLES

Three tests (tests A, B, and C) were conducted to measure efflorescence with varying compositions of unit dose packs. Tables 1A, 1B, and 1C provide the ingredients in the wash composition for tests A, B, and C, respectively. Tables 2A, 2B, and 2C provide the efflorescence test results for tests A, B, and C, respectively, where the test results are quantified using the efflorescence value as defined above, but where the storage time and temperature are provided for the efflorescence testing. The FIG. is a triangular graph that illustrates the concentrations of glycol ether, glycerin, and polyethylene glycol in the wash composition, where the area that is not shaded represents an embodiment where the concentrations of glycol ether, glycerin, and polyethylene glycol that produce a unit dose pack within the specifications defined above is produced. The specifications are: a water activity of 0.65 or less; a viscosity of 125 centipoise or greater; an efflorescence value of 25 or less, for a storage period of 2 weeks at about 45° C.; and pack haptics of 1.250 centimeters or more for a film having a thickness of 90 micrometers (microns) and pack haptics of 1.204 centimeters or more for a film having a thickness of 75 microns. The FIG. is based on the compositions in test A, and the contours of the FIG. may vary somewhat for wash compositions with different ingredients or proportions of ingredients. The desired compositions are within the non-shaded area, and higher concentrations of the glycol ether tends to produce better haptics for the unit dose pack and may result in lower costs of production. As such, higher concentrations of the glycol ether are desired.

TABLE 1A

| Sample number | Base[1] | Diethylene glycol monobutyl ether | glycerin | PEG 400[2] |
|---|---|---|---|---|
| A1 | 67.7 | 8.73 | 13.79 | 9.79 |
| A2 | 67.7 | 8.35 | 9.74 | 14.23 |
| A3 | 67.7 | 20.58 | 4.74 | 7.00 |
| A4 | 67.7 | 8.16 | 20.88 | 3.28 |
| A5 | 67.7 | 2.04 | 7.84 | 22.43 |
| A6 | 67.7 | 14.02 | 16.94 | 1.36 |
| A7 | 67.7 | 10.73 | 16.10 | 5.49 |
| A8 | 67.7 | 2.21 | 2.6 | 27.50 |
| A9 | 67.7 | 3.20 | 19.76 | 9.36 |
| A10 | 67.7 | 2.97 | 12.83 | 16.52 |
| A11 | 67.7 | 11.13 | 2.66 | 18.53 |
| A12 | 67.7 | 16.80 | 2.39 | 13.13 |
| A13 | 67.7 | 6.37 | 4.18 | 21.76 |
| A14 | 67.7 | 17.93 | 11.12 | 3.27 |
| A15 | 67.7 | 0 | 14.54 | 17.77 |
| A16 | 67.7 | 0 | 17.77 | 14.54 |
| A17 | 67.7 | 0 | 21.00 | 11.31 |
| A18 | 67.7 | 0 | 24.24 | 8.08 |

[1]The base includes: a nonionic ethoxylated surfactant at 23.074%; monoethanolamine at 1.750%; water at 7.00%; HLAS at 5.00%; coconut fatty acid at 4.00%; an anionic ethoxylated sulfate surfactant at 26.00%; bittering agent at 0.05 p %; optical brightener at 0.200%; fragrance at 0.585%; and a coloring agent at 0.026%.
[2]PEG 400 is polyethylene glycol having a weight average molecular weight of 400 daltons.

TABLE 1B

| Sample number | Base[1] | Diethylene glycol monobutyl ether | glycerin | PEG 400[2] |
|---|---|---|---|---|
| B1 | 66.7 | 0 | 14.99 | 18.32 |
| B2 | 66.7 | 0 | 18.32 | 14.99 |
| B3[2] | 66.7 | 0 | 21.66 | 11.66 |
| B4 | 66.7 | 3.33 | 19.99 | 10.00 |

TABLE 1B-continued

| Sample number | Base[1] | Diethylene glycol monobutyl ether | glycerin | PEG 400[2] |
|---|---|---|---|---|
| B5 | 66.7 | 8.33 | 21.66 | 3.33 |
| B6 | 66.7 | 8.33 | 24.99 | 0 |

[1]The base includes a nonionic ethoxylated surfactant at 23.074%; monoethanolamine at 1.750%; water at 6.000%; linear alkylbenzene sulphonic acid at 5.000%; coconut fatty acid at 4.000%; an anionic ethoxylated sulfate surfactant at 26.000%; bittering agent at 0.050%; optical brightener at 0.200%; fragrance at 0.585%; and a coloring agent at 0.026%.
[2]Sample B3 failed the haptics specification test.

TABLE 1C

| Sample number | Base[1] | Diethylene glycol monobutyl ether | glycerin | PEG 400[2] |
|---|---|---|---|---|
| C1 | 71.65 | 0 | 12.76 | 15.59 |
| C2 | 71.65 | 0 | 15.59 | 12.76 |
| C3[2] | 71.65 | 0 | 18.43 | 9.92 |
| C4 | 71.65 | 2.84 | 17.01 | 8.51 |
| C5 | 71.65 | 7.09 | 18.43 | 2.84 |
| C6 | 71.65 | 7.09 | 21.26 | 0 |

[1]The base includes a nonionic ethoxylated surfactant at 23.074%; monoethanolamine at 1.750%; water at 4.500%; linear alkylbenzene sulphonic acid at 5.000%; coconut fatty acid at 4.000%; an anionic ethoxylated sulfate surfactant at 26.000%; bittering agent at 0.050%; optical brightener at 0.300%; detergent enzymes at 2.950 percent; Imidodisuccinic acid at 0.900%; a sodium methylacrylate styrene co-polymer at 1.500%; fragrance at 1.600%; and a coloring agent at 0.026%.
[2]Sample C3 failed the haptics specification test.

TABLE 2A

| Sample[1] | Water activity | Viscosity in centipoise at 23.9° C. | E. rating at 1 week and 45° C.[2] | E. rating at 1.5 weeks and 45° C. | E. rating at 2 weeks and 45° C. | E. rating at 3 weeks and 45° C. |
|---|---|---|---|---|---|---|
| A1 | 0.5917 | 136.5 | 25 | 35 | 40 | 40 |
| A2 | 0.6107 | 141 | 25 | 30 | 40 | 40 |
| A3 | 0.6729 | 66 | 15 | 20 | 25 | 30 |
| A4 | 0.5771 | 167 | 0 | 0 | 0 | 0 |
| A5 | 0.6091 | 201 | 25 | 25 | 30 | 35 |
| A6 | 0.6065 | 104 | 0 | 0 | 10 | 20 |
| A7 | 0.5950 | 132 | 0 | 20 | 30 | 35 |
| A8 | 0.6451 | 173 | 10 | 15 | 20 | 10 |
| A9 | 0.5541 | 230 | 0 | 0 | 15 | 0 |
| A10 | 0.5869 | 197 | 25 | 30 | 30 | 40 |
| A11 | 0.6650 | 116 | 15 | 20 | 25 | 20 |
| A12 | 0.6804 | 92 | 10 | 15 | 20 | 20 |
| A13 | 0.6348 | 126 | 15 | 20 | 20 | 20 |
| A14 | 0.6274 | 90 | 0 | 15 | 20 | 25 |
| A15 | 0.5570 | 272 | 30 | 40 | 40 | 40 |
| A16 | 0.5536 | 296 | 0 | 0 | 15 | 0 |
| A17 | 0.5508 | 318 | 0 | 0 | 0 | 0 |
| A18 | 0.5333 | 369 | 0 | 0 | 0 | 0 |

[1]Haptics measured and utilized for the chart in the FIG.
[2]E. rating means efflorescence rating, measured as described above, except the storage time and storage temperature are as specified in the table.

TABLE 2B

| Sample | B1 | B2 | B3 | B4 | B5 | B6 |
|---|---|---|---|---|---|---|
| E. rating at 1 week and 23.9° C.[1] | 20 | 0 | 0 | 0 | 0 | 0 |
| E. rating at 2 weeks and 23.9° C. | 35 | 0 | 0 | 0 | 0 | 0 |
| E. rating at 4 weeks and 23.9° C. | 35 | 0 | 0 | 0 | 0 | 0 |
| E. rating at 1 week and 40.6° C. | 30 | 15 | 0 | 0 | 0 | 0 |
| E. rating at 2 weeks and 40.6° C. | 40 | 25 | 0 | 15 | 0 | 0 |
| E. rating at 4 week and 40.6° C. | 45 | 40 | 20 | 40 | 30 | 0 |
| E. rating at 1 week and 45° C. | 35 | 20 | 0 | 0 | 0 | 0 |
| E. rating at 2 weeks and 45° C. | 45 | 40 | 15 | 30 | 0 | 20 |
| E. rating at 4 weeks and 45° C. | 45 | 40 | 35 | 40 | 45 | 20 |
| E. rating at 1 week and 51.7° C. | 35 | 25 | 0 | 10 | 0 | 0 |

[1]E. rating means efflorescence rating, measured as described above, except the storage time and storage temperature are as specified in the table.

TABLE 2C

| Sample | C1 | C2 | C3 | C4 | C5 | C6 |
|---|---|---|---|---|---|---|
| E. rating at 1 week and 23.9° C.[1] | 20 | 0 | 0 | 0 | 0 | 0 |
| E. rating at 2 weeks and 23.9° C. | 30 | 10 | 0 | 0 | 0 | 0 |
| E. rating at 4 weeks and 23.9° C. | 50 | 10 | 0 | 0 | 0 | 0 |
| E. rating at 1 week and 40.6° C. | 40 | 25 | 0 | 0 | 0 | 0 |
| E. rating at 2 weeks and 40.6° C. | 45 | 40 | 0 | 10 | 10 | 0 |
| E. rating at 4 week and 40.6° C. | 50 | 50 | 35 | 45 | 35 | 0 |
| E. rating at 1 week and 45° C. | 45 | 30 | 0 | 0 | 0 | 0 |
| E. rating at 2 weeks and 45° C. | 50 | 40 | 15 | 25 | 15 | 0 |
| E. rating at 4 weeks and 45° C. | 50 | 50 | 40 | 50 | 45 | 0 |
| E. rating at 1 week and 51.7° C. | 45 | 35 | 10 | 10 | 0 | 0 |

[1]E. rating means efflorescence rating, measured as described above, except the storage time and storage temperature are as specified in the table.

Samples A4, A6, A7, A9, B4, B5, B6, C4, C5, and C6 have solvent loadings within the ranges described above, namely glycol ethers from about 2 to about 15 weight percent, glycerin from about 15 to about 26 weight percent, and polyethylene glycol from about 0 to about 12 percent. As can be seen, the combinations of glycol ether, glycerin, and polyethylene glycol that fall within the described ranges have superior efflorescence performance. The higher concentrations of the ethylene glycol component (i.e., diethylene glycol monobutyl ether) tend to have superior haptics, so higher ethylene glycol concentrations are preferred.

It is noted that increases in glycerin and polyethylene glycol may reduce efflorescence, but the pack haptics are also unacceptably reduced. Efflorescence values for Samples B3 and C3 are similar to efflorescence values for Samples B5 and C5, respectively, where Samples B5 and C5 have diethylene glycol monobutyl ether substituted for some of the polyethylene glycol from Samples B3 and C3 respectively. However, Samples B3 and C3 failed the haptics specification test, and Samples B5 and C5 passed the haptics specification test. This demonstrates the value of diethylene glycol monobutyl ether in the wash composition for improved haptics, while also helping to reduce efflorescence. Increasing the relative concentration of diethylene glycol monobutyl ether may improve the efflorescence performance while also providing acceptable pack haptics. Non-aqueous solvent loadings that soften the film tend to provide superior efflorescence performance, but the softer film decreases the haptics performance. Glycerin tends to soften the film, and polyethylene glycol softens the film more than diethylene glycol monobutyl ether. Therefore, efflorescence values may be controlled by increasing the relative concentrations of glycerin and/or polyethylene glycol, but at the cost of decreased pack haptics. Non-aqueous solvent loadings should be balanced to produce a unit dose pack that provides acceptable pack haptics and also reduces efflorescence, and the inclusion of diethylene glycol monobutyl ether in the wash composition at the concentrations described above aids in that balance.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A unit dose pack comprising:

a film;

a wash composition encapsulated within the film to form the unit dose pack, wherein the wash composition comprises a glycol ether in an amount of from about 2 to about 15 weight percent, glycerin in an amount of from about 15 to about 26 weight percent, and polyethylene glycol in an amount of from about 0 to about 12 weight percent, all based on a total weight of the wash composition, wherein a ratio of the glycol ether concentration to the glycerin concentration is from 0.16 to 0.39, and wherein a sum of the amounts of the glycol ether, the glycerin, and the polyethylene glycol is from about 26 to about 40 weight percent, based on the total weight of the wash composition.

2. The unit dose pack of claim 1 wherein the glycol ether is diethylene glycol monobutyl ether.

3. The unit dose pack of claim 1 wherein the glycerin is present in an amount of from 16 to 25 weight percent, based on the total weight of the wash composition.

4. The unit dose pack of claim 1 wherein the wash composition further comprises an anti-redeposition agent in an amount of from about 0.5 to about 5 weight percent, based on the total weight of the wash composition.

5. The unit dose pack of claim 4 wherein:

the film has an efflorescence value of about 25 or less at about 2 weeks storage at about 45 degrees Celsius.

6. The unit dose pack of claim 4 wherein the anti-redeposition agent is a sodium methylacrylate styrene copolymer.

7. The unit dose pack of claim 6 wherein the wash composition further comprises an enzyme.

8. The unit dose pack of claim 1 wherein the wash composition comprises the glycol ether in an amount of from 3 to 8 weight percent, the glycerin in an amount of from 16 to 25 weight percent, and the polyethylene glycol in an amount of from 2 to 10 weight percent, all based on the total weight of the wash composition.

9. The unit dose pack of claim 8 wherein the glycol ether is diethylene glycol monobutyl ether, and wherein the ratio of the glycol ether concentration to the glycerin concentration is from 0.2 to 0.39.

10. The unit dose pack of claim 1 wherein the wash composition has a water activity of 0.65 or less.

11. The unit dose pack of claim 1 wherein the glycol ether in an amount of from 3 to 12 weight percent, the glycerin in an amount of from 16 to 25 weight percent, and the polyethylene glycol in an amount of from 0 to 10 weight percent, all based on the total weight of the wash composition, and wherein the ratio of the glycol ether concentration to the glycerin concentration is from 0.2 to 0.39.

12. The unit dose pack of claim 11 wherein the film has an efflorescence value of about 25 or less at about 2 weeks storage at about 45 degrees Celsius.

13. The unit dose pack of claim 1 wherein the polyethylene glycol is present in the wash composition in an amount of from about 0 to about 10 weight percent, based on the total weight of the wash composition.

14. The unit dose pack of claim 1 wherein the wash composition further comprises a coconut fatty acid in an amount of from about 0.5 to about 8 weight percent, an optical brightener in an amount of from about 0.01 to about 1 weight percent, monoethanolamine in an amount of from about 0.5 to about 5 weight percent, and an anionic surfactant in an amount of from about 20 to about 35 weight percent, all based on the total weight of the wash composition.

15. The unit dose pack of claim 1 wherein the glycol ether is diethylene glycol monobutyl ether, the glycol ether is present in an amount of about 8 weight percent, the glycerin is present in an amount of about 21 weight percent, and the polyethylene glycol is present in an amount of about 3 weight percent, all based on the total weight of the wash composition.

16. The unit dose pack of claim 1 wherein:

wherein the glycol ether is present in an amount of from about 3 to about 12 weight percent of the wash composition, the glycerin is present in an amount of from about 16 to about 25 weight percent of the wash composition, and the polyethylene glycol is present in an amount of from about 0 to about 10 weight percent of the wash composition, based on the total weight of the wash composition.

17. The unit dose pack of claim 1 wherein a ratio of the glycol ether concentration to the glycerin concentration is from 0.2 to 0.39.

18. The unit dose pack of claim 1 wherein:

the film has an efflorescence value of about 10 or less at about 2 weeks storage at about 45 degrees Celsius.

19. A method of producing a unit dose pack comprising:

forming a wash composition comprising a glycol ether in an amount of from about 2 to about 15 weight percent, glycerin in an amount of from about 15 to about 26 weight percent, and polyethylene glycol in an amount of from about 0 to about 12 weight percent, all based on a total weight of the wash composition, and wherein a sum of the amounts of the glycol ether, the glycerin, wherein a ratio of the glycol ether concentration to the glycerin concentration is from about 0.16 to 0.39, and the polyethylene glycol is from about 26 to about 40 weight percent, based on the total weight of the wash composition; and encapsulating the wash composition within a film to produce the unit dose pack.

20. A unit dose pack comprising:

a film;

a wash composition encapsulated within the film, wherein the wash composition comprises monoethanolamine in an amount of from about 0.5 to about 5 weight percent, water in an amount of from about 3 to about 12 weight percent, a coconut fatty acid in an amount of from about 0.5 to about 8 weight percent, an anionic surfactant in an amount of from about 20 to about 35 weight percent, a nonionic ethoxylated surfactant in an amount of from about 15 to about 30 weight percent, an optical brightener in an amount of from about 0.1 to about 1 weight percent, a bittering agent in an amount of from about 0.001 to about 0.2 weight percent, diethylene glycol monobutyl ether in an amount of from about 3 to about 12 weight percent, glycerin in an amount of from about 16 to about 25 weight percent, and polyethylene glycol in an amount of from about 0 to about 10 weight percent, all based on a total weight of the wash composition, and wherein a ratio of the glycol ether concentration to the glycerin concentration is from 0.16 to 0.39.

* * * * *